US007451629B2

(12) United States Patent
Dickinson

(10) Patent No.: US 7,451,629 B2
(45) Date of Patent: Nov. 18, 2008

(54) SPIRAL PIPE MACHINE

(75) Inventor: Gary L. Dickinson, River Grove, IL (US)

(73) Assignee: Formtek, Inc., Westfield, MA (US)

( * ) Notice: Subject to any disclaimer, the term of this patent is extended or adjusted under 35 U.S.C. 154(b) by 21 days.

(21) Appl. No.: 11/398,432

(22) Filed: Apr. 5, 2006

(65) Prior Publication Data

US 2007/0234770 A1 Oct. 11, 2007

(51) Int. Cl.
*B21C 37/12* (2006.01)
*B21F 3/04* (2006.01)

(52) U.S. Cl. ..... 72/49; 72/145

(58) Field of Classification Search ..... 72/48–50, 72/135, 137–139, 142, 143, 145, 146, 148, 72/169, 173, 174; 264/285, 295, 320, 339; 425/383, 402; 138/129, 130, 150, 154; 242/534, 242/534.1, 535.1
See application file for complete search history.

(56) References Cited

U.S. PATENT DOCUMENTS 3,677,046 A * 7/1972 Carroll ..... 72/49
3,940,962 A * 3/1976 Davis ..... 72/50
6,339,945 B2 * 1/2002 Miller et al. ..... 72/49
6,561,228 B1 * 5/2003 Lennartsson ..... 138/136
7,137,281 B1 * 11/2006 McCorvey ..... 72/49

* cited by examiner

*Primary Examiner*—Derris H. Banks
*Assistant Examiner*—Teresa Bonk
(74) *Attorney, Agent, or Firm*—McCormick, Paulding & Huber LLP

(57) ABSTRACT

A spiral pipe machine includes a feeding assembly for continuously feeding a web of material, and a forming assembly for accepting the web. The forming assembly bends the web to form a first section of a spiral pipe having a first predetermined diameter. A controller is employed for selectively instructing the forming means to change its configuration so as to give a second section of the spiral pipe a second predetermined diameter. The controller is capable of controlling the forming station to transition from the first predetermined diameter to the second predetermined diameter during the continuous feeding of the web.

13 Claims, 5 Drawing Sheets

SPIRAL PIPE MACHINE

FIELD OF INVENTION

The present invention relates, in general, to a spiral pipe machine, and deals more particularly with a spiral pipe machine capable of automatically changing the diameter of manufactured round ducts without interrupting the operation of the spiral pipe machine.

BACKGROUND OF THE INVENTION

HVAC systems are well known in both residential and commercial environments, and are typically utilized to maintain the environmental conditions within a closed space, such as a building.

A key component of any HVAC system is the ductwork within such a system. Known ductwork can take any particular cross-sectional shape, but is usually either square or round. The ductwork is substantially sealed against ambient environmental contaminants and interference, and often extends great linear distances when incorporated throughout an entire building, or complex of buildings.

As the ductwork threads its way throughout the superstructure of a given building, it is often necessary and desirable to have the cross-sectional size, or diameter, of the ductwork change at some point along its length. Changing the cross-sectional diameter of a round length of ductwork, however, is a cumbersome and time consuming task, given the present state of the art.

As known to those in the relevant art, there currently exists spiral pipe machines that manufacture variable lengths of round cross-sectional ductwork. These machines typically accept a flattened, metallic workpiece, and through a system of known rollers and metal forming components, these known machines output the finished length of round ductwork.

As noted above, the problem with these known spiral pipe machines is that production of the machine (including feeding of the web) must be stopped every time a different diameter of ductwork is desired. In addition to the lost productivity caused by shutting the machine down, it is also necessary in these known systems to manually change internal mandrels, and the like, in order to facilitate the change in ductwork diameter. Subsequent to the formation of a differing sized piece of ductwork, it then becomes necessary to manually join the two lengths of differing sized ductwork via a separately formed transition element. Thus, the known method and apparatus for altering the diameter of a given spiral pipe is time consuming, labor intensive and generally inefficient.

It will thus be readily appreciated that there exists a need in the art for a spiral pipe machine that reduces the time and labor involved in changing between different diameters of manufactured spiral pipe, or ductwork.

With the forgoing problems and concerns in mind, it is the general object of the present invention to provide a spiral pipe machine capable of automatically changing the diameter of manufactured round ducts without interrupting the operation of the spiral pipe machine.

SUMMARY OF THE INVENTION

It is one object of the present invention is to provide a spiral pipe machine.

It is another object of the present invention is to provide a spiral pipe machine that is capable of automatically changing the diameter of manufactured round ducts.

It is another object of the present invention is to provide a spiral pipe machine that is capable of automatically changing the diameter of manufactured round ducts without interrupting the operation of the spiral pipe machine.

It is another object of the present invention is to provide spiral pipe machine that ensures the proper alignment of the manufactured pipe.

It is another object of the present invention is to provide spiral pipe machine that ensures the proper alignment of the manufactured pipe.

In accordance, therefore, with one embodiment of the present invention, a spiral pipe machine includes a feeding assembly for continuously feeding a web of material, and a forming assembly for accepting the web. The forming assembly bends the web to form a first section of a spiral pipe having a first predetermined diameter. A controller is employed for selectively instructing the forming means to change its configuration so as to give a second section of the spiral pipe a second predetermined diameter. The controller is capable of controlling the forming station to transition from the first predetermined diameter to the second predetermined diameter during the continuous feeding of the web.

These and other objectives of the present invention, and their preferred embodiments, shall become clear by consideration of the specification, claims and drawings taken as a whole.

DETAILED DESCRIPTION OF THE PREFERRED EMBODIMENTS

Figure 1:
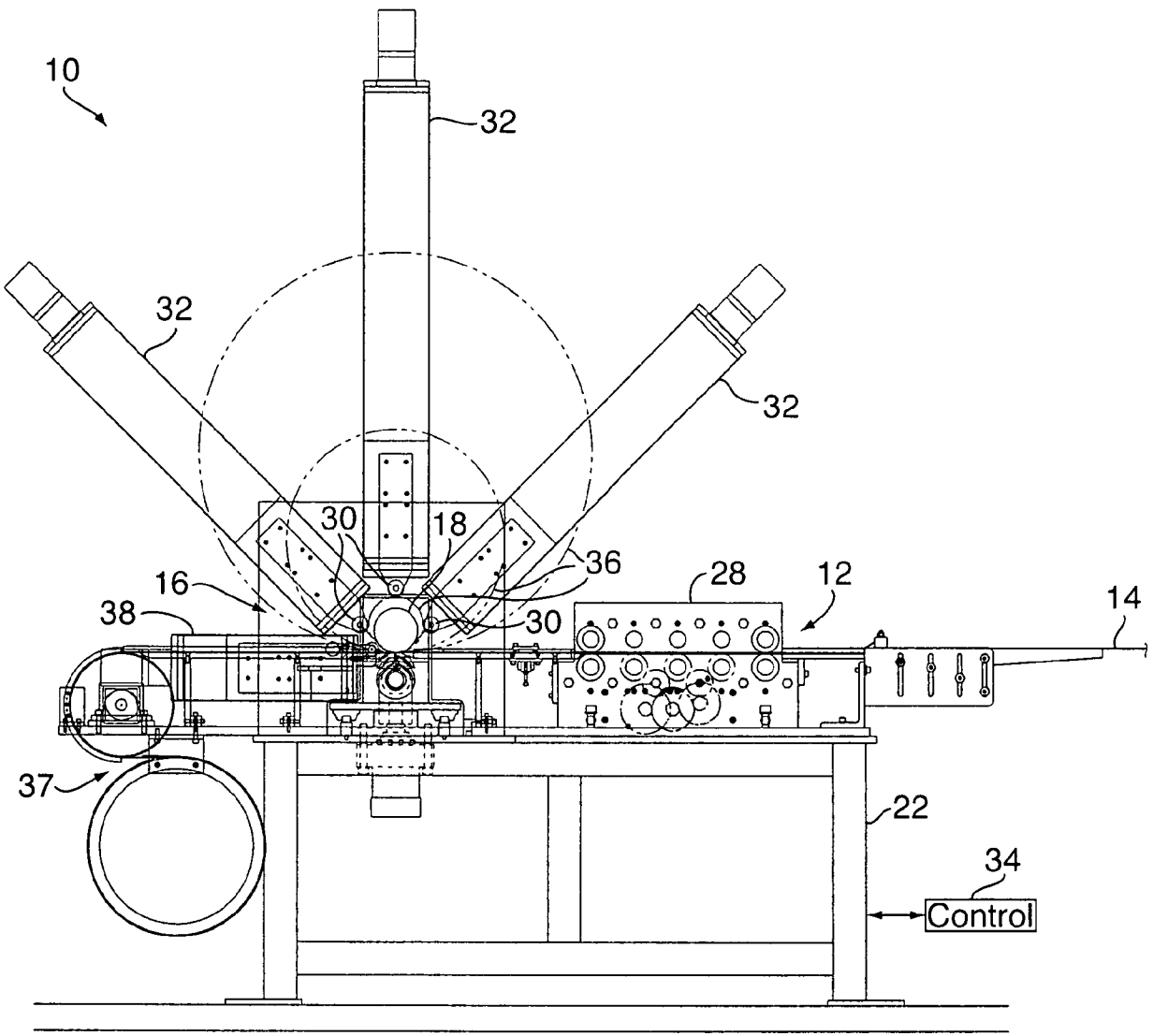
FIG. 1 is a front-end view of a spiral pipe machine 10, in accordance with one embodiment of the present invention.

FIG. 1 is a front-end view of a spiral pipe machine 10, in accordance with one embodiment of the present invention. The spiral pipe machine 10 comprises a feed-in guide assembly 12 (also shown in FIG. 2) for continuously feeding a substantially flattened strip, or web, 14 of material (such as metal) into the machine 10. A multiple roll, spiral pipe-forming apparatus 16 is utilized for forming the strip 14 into a spiral pipe 18 of optionally different diameters. The feeding direction of the web 14, and the output direction of the manufactured spiral pipe, are approximately orthogonal to one another It will be readily appreciated that the term 'spiral pipe', as utilized herein, refers to a length of metallic ductwork that is manufactured to be substantially round in cross-section. Moreover, it is also known that the seam of the manufactured ductwork defines a spiral, rather than a linear, seam as it extends along the length of the spiral pipe.

As the components for, and the general operation of, existing spiral pipe machines are known in the art, further discussion on the spiral pipe machine of the present invention will concentrate on those aspects of the present invention which extent beyond the current knowledge of one of ordinary skill in the art. That is, the present invention will concentrate on those aspects of the spiral pipe machine which enable the uninterrupted formation of differing sizes of ductwork, the general operation of known spiral pipe machines being herein incorporated by reference.

Returning to FIG. 1, the spiral pipe machine 10 includes a base 22 upon which substantially all of the components are mounted. The feed-in guide assembly 12 feeds the strip 14 through the main drive system 28, which comprises a plurality of pairs of rolls, each having an upper roll and a lower roll. The pairs of rolls receive the strip 14 and send it into the spiral pipe-forming apparatus 16.

As also shown in FIG. 1, the spiral pipe-forming apparatus 16 comprises multiple (three) sets of rolls 30, which are themselves under the control of a series of three actuators 32. The actuators 32 may be either hydraulic or pneumatic in nature, and are selectively operated by an operator's control pedestal and/or a computerized command console 34.

As discussed hereinafter, the command console 34 may take any form or configuration, provided it is capable of maintaining and executing operation software for the machine 10, as well as accepting manually inputted commands from an operator for effecting the same. The command console 34 is in bi-lateral electrical communication with the machine 10, and is preferably a CNC (Computerized Numerical Control) machine capable of coordinating all operations of the machine 10.

Figure 3:
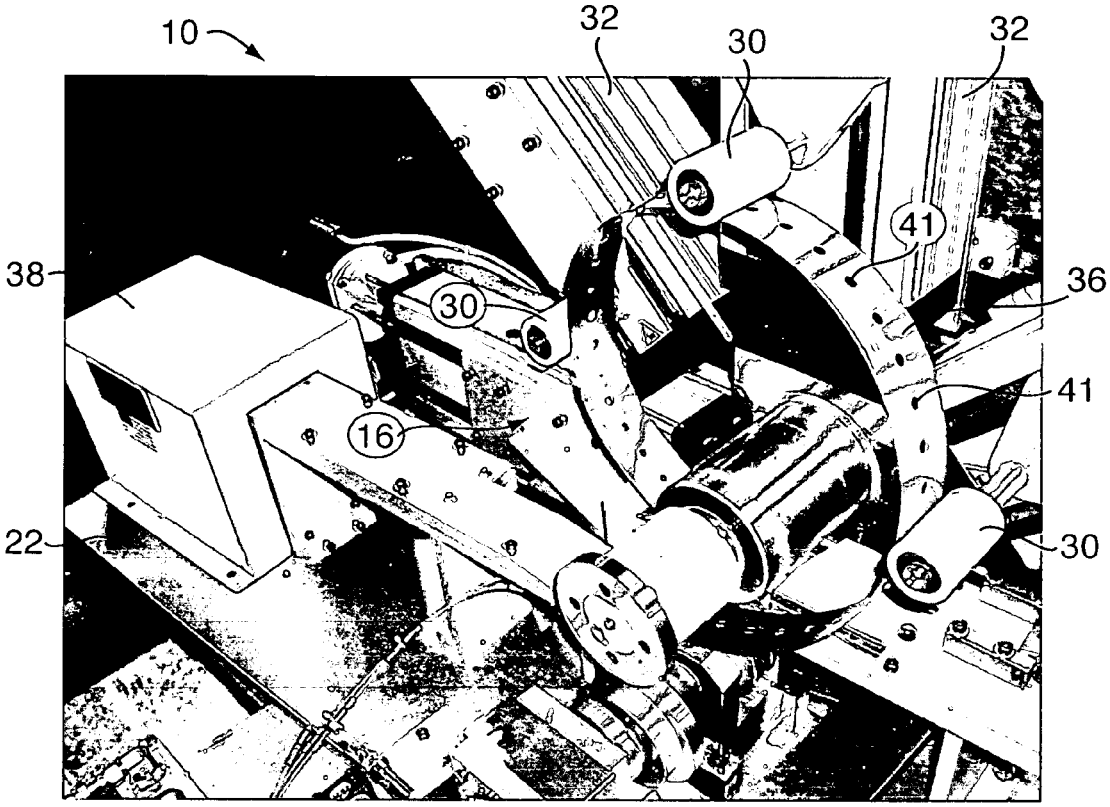
FIG. 3 illustrates the forming means for the spiral pipe machine of FIG. 1.

FIG. 3 illustrates a close-up view of the rolls 30 and the actuators 32 of the present invention. In operation, as the web 14 is provided to the spiral pipe-forming apparatus 16 from the side thereof, the web 14 becomes incident upon the inner periphery of a control band 36. Further feeding of the web 14 will cause the web 14 to travel about the inner periphery of the control band 36 in a helical fashion, while opposing male and female seams will be formed upon the web 14 in accordance with well known metal bending techniques. The male and female seam edges are thereafter joined via a known hydraulic crimping roll assembly, and the finished spiral pipe exits the machine 10 in a direction approximately perpendicular to the feeding direction of the web 14.

A ratchet box 38 is also provided to the machine 10, and operates under the control of the command console 34 to selectively expel or retract the control band 36. The control box may utilize a gear wheel, or the like, to selectively and incrementally interact with the feeding holes 41 formed in the control band 36, so as to alternatively push or pull the control band 36 in accordance with the desired diameter of the spiral pipe.

When an operator desires to change the diameter of the spiral pipe being formed by the machine 10, the particular diameter and length of the spiral pipe is entered into the command console 34. The command console 34 will then control the band 36 to either expand or contract, in a controlled and graduated manner, so as to cause the helical bending of the web 14 to likewise expand or contract to meet the predetermined diameter. In this manner, changes in the diameter of the manufactured spiral pipe may be accomplished without ceasing operation of the machine 10. FIG. 1 shows several possible contracted or expanded positions of the control band 36. The command console 34 may also automatically determine the diameter of the spiral pipe which is to be formed, in dependence upon specific design parameters that may be communicated to the command console 34 from ancillary computer systems (as will be discussed in more detail later).

As shown in FIG. 1, a band drum and storage device 37 is employed to house and manage the unused portion of the control band 36. It will also be readily appreciated that the command console 34 may cause the control band 36 to contract or expand at varying rates, which has the effect of selectively causing a gradual, or more radial, reduction or enlargement of the diameter of the spiral pipe. That is, the rate at which the control band 34 contracts or expands (in combination with the feeding speed of the machine 10) will thereby control the corresponding rate of reduction or increase in the transitional portion of the spiral pipe. Thus, the controlled operation of the band 36 can selectively promote a sever, or more gentle, transition between pipe lengths of differing diameters.

It is therefore an important aspect of the present invention that the machine 10 is capable of altering the diameters in a given spiral pipe without interrupting the operation of the machine 10 itself. Moreover, the present invention can also effectuate a controlled rate of transition (i.e., the slope of the transition portion of the spiral pipe) from one diameter to another, by controlling the speed of the web 14 feeding, in conjunction with coordinating the speed of the control band's 36 contraction or expansion.

As also shown in FIG. 3, however, the control band 36 is assisted in its formation of a particular diameter by the action of the rolls 30. In addition to coordinating the speed of the web 14 and the speed of the control band 36, the command console 34 will also coordinate the operation of the actuators 32, in dependence upon the desired diameter of the spiral pipe.

Therefore, as the control band 36 is either expanded or contracted, the actuators 32 will cause the rolls 30 to move in a matching and substantially rectilinear manner, to thereby impact the exterior periphery of the control band 36, all under the control of the command console 34.

It is therefore another important aspect of the present invention that by causing the actuators 32 to move in a coordinated manner with the control band 36, the command console 34 ensures that the rolls 30 provide the structural support to the control band 36 which is needed to effectuate an exacting reduction or expansion of the diameter of the spiral pipe being manufactured. Moreover, by providing several points of contact with the control band 36, the rolls 30 assist in maintaining a substantially circular cross-section to the spiral pipe, by ensuring that the incident force from the actuators 32 is distributed fairly equally about the exterior periphery of the control band 36.

Figure 4:
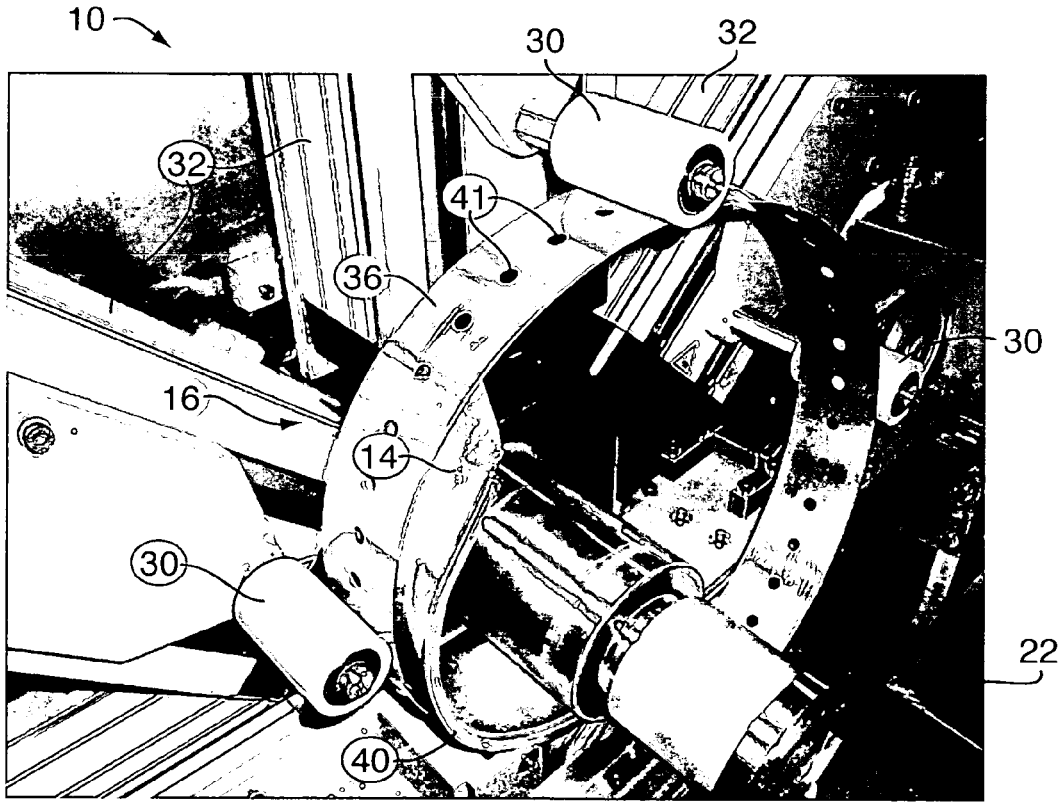
FIG. 4 is a dose-up view of the forming means shown in FIG. 3, as the web of material is formed therein.

FIG. 4 more dearly shows the web 14 as it is being fed and guided by the inner periphery of the control band 36. Moreover, FIG. 4 also shows the close contact of the rolls 30, as well as the first half of a seam 40 formed on the web 14.

It has been noted that during the formation of the spiral pipe, especially when changes of diameters are instructed by the command console 34, the finished spiral pipe exiting the machine 10 oftentimes diverts from its lineal axis. That is, as the spiral pipe is being formed and controlled to a differing diameter, the spiral pipe will oftentimes exit the machine in an off-axis state, which is highly undesirable.

It is therefore yet another important aspect of the present invention that the machine 10 is capable of correcting for these off-axis distortions by selectively kilting the base of the spiral pipe-forming apparatus 16 and the feed-in guide assembly 12, to thereby straighten the finished spiral pipe.

Figure 2:
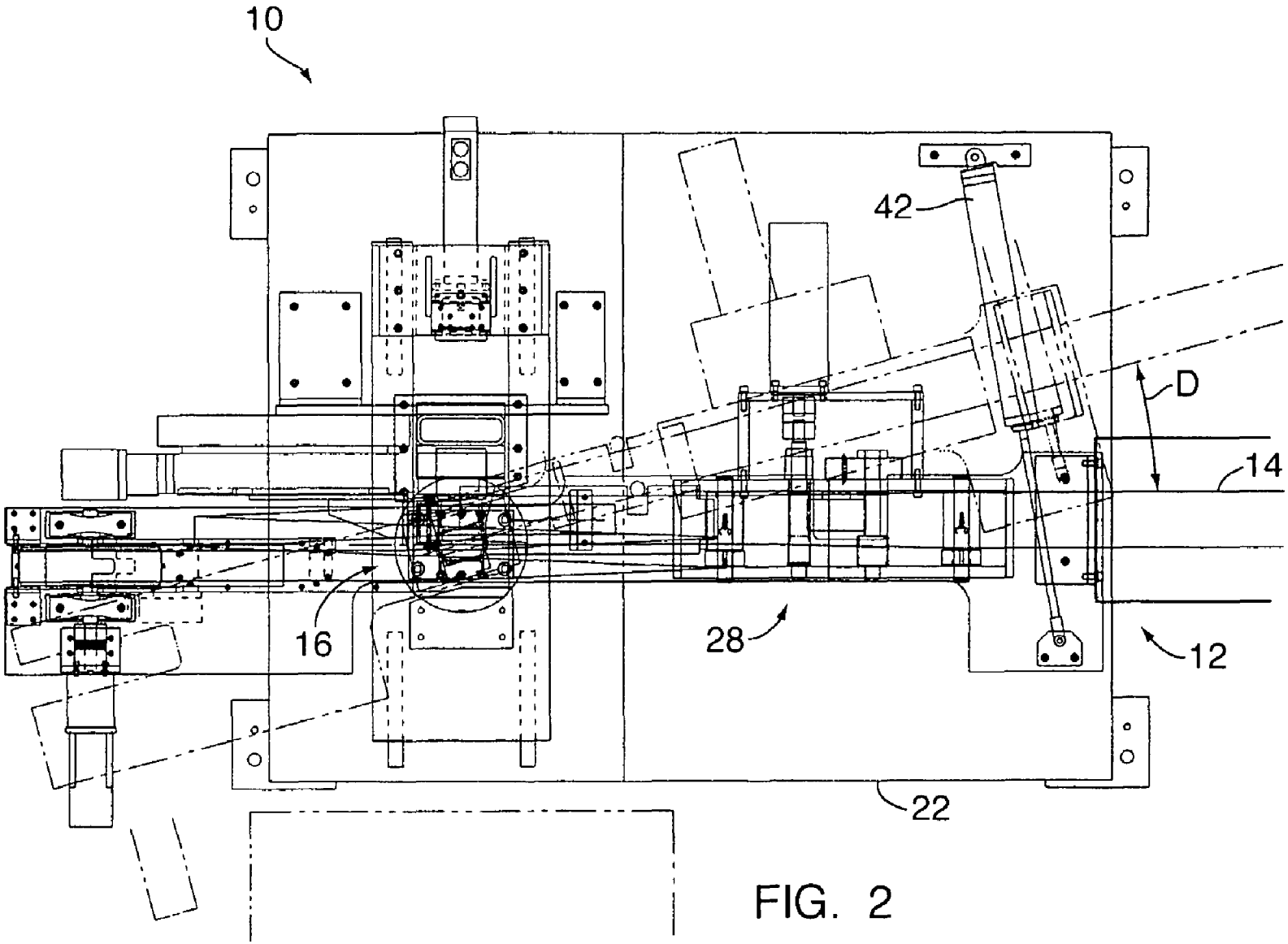
FIG. 2 is a top plan view of the spiral pipe machine of FIG. 1.

As best shown in FIG. 2, a correcting actuator 42, which may be either pneumatic or hydraulic in nature, is selectively controlled by the command console 34 to shift, or pivot, the spiral pipe-forming apparatus 16 and the feed-in guide assembly 12 along or in the general direction of arrow D, so as to accommodate and compensate for the off-axis deviation of the spiral pipe as it exits the machine 10.

Thus, the present invention advantageously permits the uninterrupted manufacture of a spiral pipe, inclusive of the uninterrupted formation of changes in diameter of the spiral pipe. Moreover, the present invention automatically controls the rate of transition between pipe sections of differing diameters, while also accounting for and correcting any off-axis deviation of the spiral pipe as it is exits the machine 10. The present invention therefore overcomes the disadvantages of the prior art in which the operation of known, spiral pipe machines must be interrupted in order to change their fixed mandrels, when a differing diameter pipe section is desired.

As discussed above, all control processes of the spiral pipe machine 10 are controlled and coordinated with each other through the command console 34 and/or manual control of the same.

The present invention is therefore an apparatus for forming spiral tubes from strips, which comprises a tube forming system which forms a strip/web 14 of material, such as metal, into a spiral tube, and a strip infeed system which is adapted for feeding a strip to the spiral tube forming system. The tube forming process is accomplished by three rolls 30 incident upon a control band 36 which itself surrounds and directs the incident web 14. Each roll former 30 is attached to a CNC-controlled actuator 32. The present invention includes a computer command console 36 that adjusts the actuators 32 in order to change the diameter of the pipe, as desired and without any interruption in the operation of the machine 10.

This computer command console 36 is preferably a seven axis CNC machine. The computer command console 36 enables the formation of a spiral pipe having diameters that can be increased and decreased while the machine is running. While doing this, the pipe must stay straight when it exits the forming dies, and the present invention utilizes a correcting actuator 42 to move the spiral pipe-forming apparatus 16 and the feed-in guide assembly 12, under control of the command console 34, to keep the pipe straight.

Of particular interest is the ability of the present invention to permit the operator to input the overall length of the spiral pipe to be formed, along with the number of reductions (in diameter) that are required. For example, an operator could input the reduction of a twenty-inch diameter spiral pipe to a fifteen-inch diameter spiral pipe after ten feet of pipe, and then a reduction from a fifteen-inch diameter spiral pipe to one of ten inches after another eight feet of spiral pipe had been produced. By allowing the operator to input this information at the time of production, the hand installation of reducers and the required two joints per transition, made be eliminated. The cost savings per pipe can be quite substantial.

Figure 5:
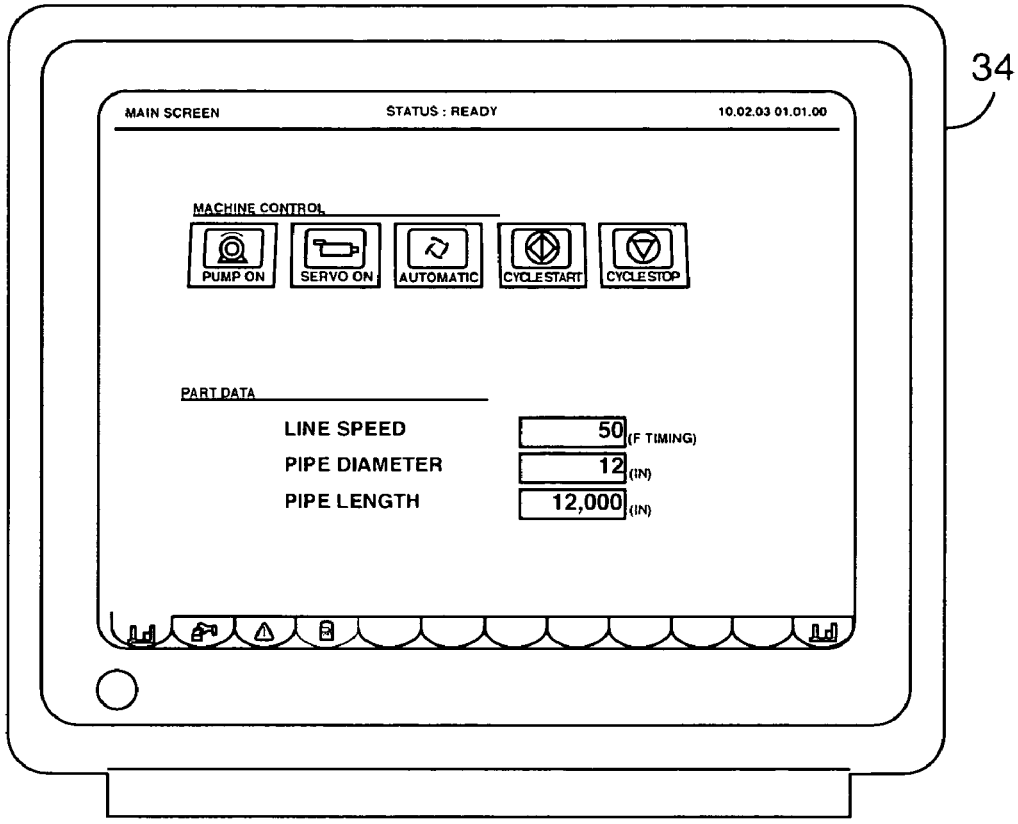
FIG. 5 illustrates one possible configuration for a data interface screen of the machine command console.

FIG. 5 illustrates one possible configuration for the data interface screen of the command console 34. As shown in FIG. 5, an operator may set the line speed of the feeding means (the feed-in guide assembly 12), the desired diameter of the spiral pipe to be produced, and the length of the pipe that is to be produced at the instructed diameter. Utilizing dedicated software, the command console 34 will thereafter coordinate the operations of all components of the spiral pipe machine 10, to ensure that the finished manufactured spiral pipe meets the criteria set out by the operator.

It will be readily appreciated that the CNC command console 34 may be in data communication with an inventory and Computer Assisted Drafting (CAD) system, so as to assist the operator of the spiral pipe machine 10 in the formation of spiral pipes. That is, the command console 34 is capable of receiving data from the inventory and CAD system, thereby enabling the automated selection of appropriately sized webs to be used during the formation of spiral pipes. By permitting the automated selection of appropriate webs, the command console 34 can also ensure that spiral pipes are fabricated in a manner—and in an order—which most effectively utilizes the existing inventory of web workpieces, while significantly reducing leftover waste material.

Thus, the automated nature of the present invention permits the command console 34 to review the required diameter and distance of all the spiral pipes that need to be made for a given job, and then organize the manufacture of these pipes in consideration of the existing web inventory so as to reduce the amount of leftover waste material.

Figure 6:
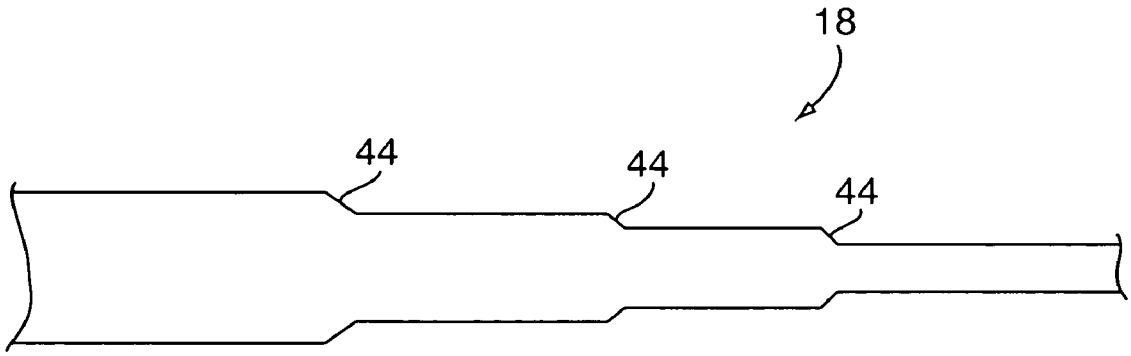
FIG. 6 is a cross-sectional view of a spiral pipe made in accordance with the present invention.

Thus, the present invention eliminates the additional installation time and piece-production of typical spiral pipes, by creating a one-piece pipe production. Since the spiral pipe manufactured by the present invention is one continuous piece, the present invention reduces labor, costs, and leakages. FIG. 6 illustrates a cross-section of a one-piece spiral pipe 18 as manufactured by the present invention. As shown in FIG. 6, the spiral pipe 18 exhibits several transitions 44 between differing diameters, all of which can be accomplished without interrupting the continuous operation of the machine 10 of the present invention. As discussed previously, the transitions 44 are formed under the direction of the command console 34, and via the coordinated operation of the control band 36 and the rolls 30.

Figure 7:
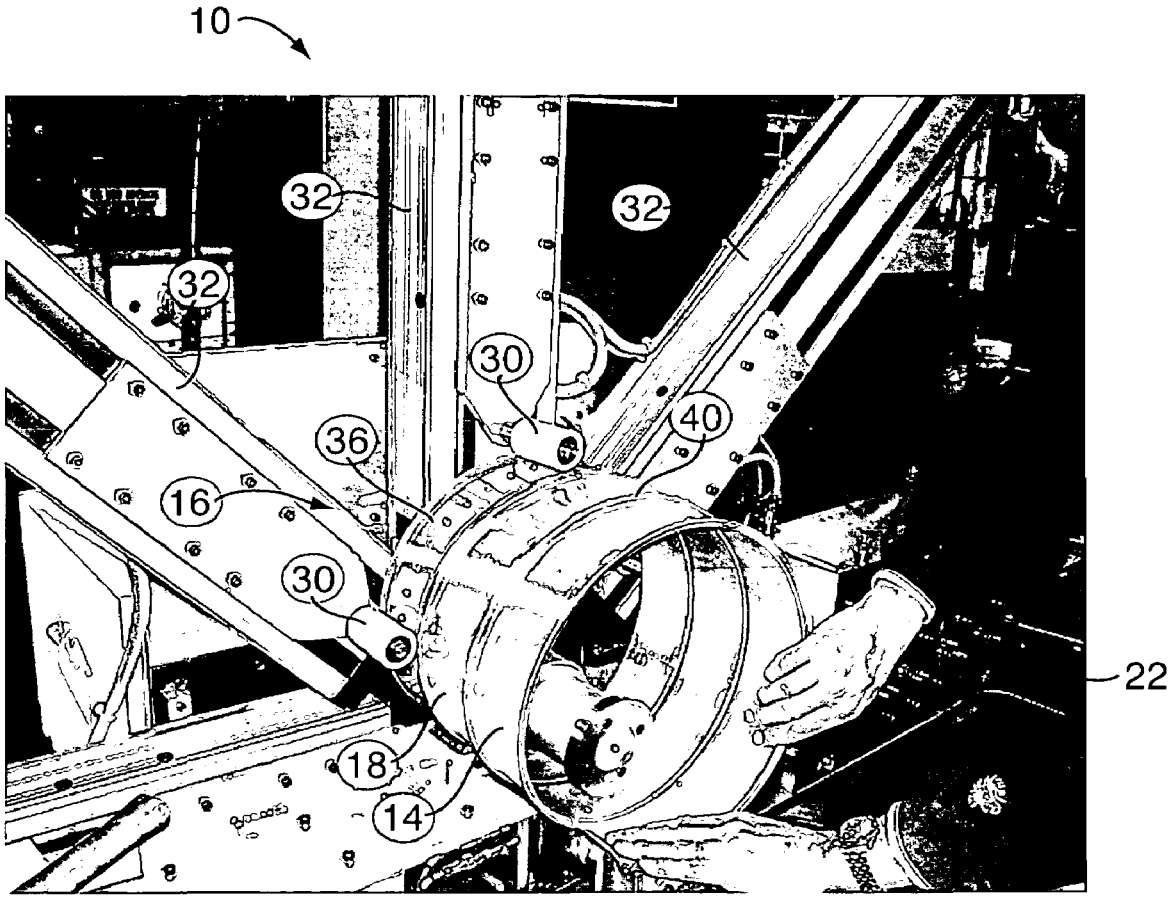
FIG. 7 illustrates the spiral pipe machine of the present invention as it is producing a section of spiral pipe.

FIG. 7 illustrates the spiral pipe machine 10 in operation, as a spiral pipe 18 is being formed. As shown in FIG. 6, the rollers 30 have been positioned by the actuators 32 so as to contact and apply force to several, substantially equidistant locations about the exterior periphery of the control band 36.

It will be readily appreciated that the present invention includes additional capabilities, such as having a cut-off die by which the present invention threads the manufactured spiral pipe, as well as a slitter cutter for cutting the manufactured spiral pipe to size.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A spiral pipe machine, comprising:

feeding means for feeding a web of material;

forming means for accepting said web, said forming means bending said web to form a spiral pipe having a predetermined diameter;

a controller for selectively controlling said forming means to change in configuration, thereby altering said predetermined diameter of said spiral pipe during continuous feeding of said web;

wherein said forming means includes a control band; and wherein said web is fed by said feeding means such that said web contacts an inner periphery of said control band.

2. The spiral pipe machine of claim 1, wherein:

said forming means includes an actuator having a roller; and wherein said roller selectively exerts force upon said web.

3. The spiral pipe machine of claim 1, wherein:

said forming means further includes an actuator having a roller; and wherein said roller selectively exerts force upon an exterior periphery of said control band.

4. The spiral pipe machine of claim 1, wherein:

said forming means further includes a plurality of actuators, each of said actuators having a roller; and wherein each said roller selectively exerts force at a different location about an exterior periphery of said control band.

5. The spiral pipe machine of claim 4, wherein:

said forming means further includes a band control means; and wherein said control band includes a plurality of feeding holes formed therein, said band control means selectively interacting with said feeding holes to cause said control band to change its pipe forming diameter.

6. The spiral pipe machine of claim 5, wherein:

said controller selectively causes said rollers to move in concert with said control band.

7. The spiral pipe machine of claim 6, wherein:

said controller is a CNC machine.

8. A method for selectively altering a diameter of a spiral pipe during a continuous feeding of a web from which the spiral pipe is formed, said method comprising the steps of:

feeding said web to a forming station;

bending said web via said forming station to form a spiral pipe having a predetermined diameter;

controlling said forming station to selectively cause said forming station to change its configuration, thereby altering said predetermined diameter of said spiral pipe during said continuous feeding of said web;

including a control band in said forming station, said control band being arranged in a path of said web; and feeding said web such that said web becomes incident upon an inner periphery of said control band.

9. The method for selectively altering a diameter of a spiral pipe during a continuous feeding of a web according to claim 8, further comprising the steps of:

including a displacable roller in said forming station; and selectively causing said roller to exert an incident force upon said web.

10. The method for selectively altering a diameter of a spiral pipe during a continuous feeding of a web according to claim 8, further comprising the steps of:

including an actuator having a roller as part of said forming station; and selectively energizing said actuator to cause said roller to exert a force upon an exterior periphery of said control band.

11. The method for selectively altering a diameter of a spiral pipe during a continuous feeding of a web according to claim 8, further comprising the steps of:

including a plurality of displacable rollers in said forming station; and selectively causing said rollers to exert force at different locations about an exterior periphery of said control band.

12. The method for selectively altering a diameter of a spiral pipe during a continuous feeding of a web according to claim 11, further comprising the steps of:

including a band control means in said forming station; and forming a plurality of feeding holes in said control band, said band control means selectively interacting with said feeding holes to cause said control band to change its pipe forming diameter.

13. The method for selectively altering a diameter of a spiral pipe during a continuous feeding of a web according to claim 12, further comprising the steps of:

selectively causing said rollers to move in concert with said control band.

* * * * *